US006883191B2

(12) United States Patent
Gaboury et al.

(10) Patent No.: US 6,883,191 B2
(45) Date of Patent: Apr. 26, 2005

(54) LEG AND BRACKET ASSEMBLY FOR A BED FOUNDATION

(75) Inventors: James D. Gaboury, Andover, MN (US); James E. Gifft, Maple Grove, MN (US); Daniel J. Koughan, Eden Prairie, MN (US); Brian C. Beth, Hinsdale, IL (US); Donald J. Smith, Perrysburg, OH (US); Michael A. Andreini, Stillwater, MN (US); Alan L. Carlson, St. Paul, MN (US); Kevin J. Ward, Anoka, MN (US)

(73) Assignee: Select Comfort Corporation, Minneapolis, MN (US)

( * ) Notice: Subject to any disclaimer, the term of this patent is extended or adjusted under 35 U.S.C. 154(b) by 0 days.

(21) Appl. No.: 10/284,634

(22) Filed: Oct. 31, 2002

(65) Prior Publication Data

US 2003/0079284 A1 May 1, 2003

Related U.S. Application Data

(63) Continuation-in-part of application No. 09/900,685, filed on Jul. 6, 2001, now abandoned.

(60) Provisional application No. 60/216,908, filed on Jul. 7, 2000.

(51) Int. Cl.[7] ..... A47C 19/02

(52) U.S. Cl. ..... 5/201; 5/400; 5/310; 5/131; 5/286

(58) Field of Search ..... 5/310, 400, 282.1, 5/285, 286, 131, 132, 200.1, 201

(56) References Cited

U.S. PATENT DOCUMENTS

| | | | | |
|---|---|---|---|---|
| 2,263,050 A | * | 11/1941 | Rein | 5/296 |
| 3,105,976 A | * | 10/1963 | Roche | 5/285 |
| 3,754,289 A | | 8/1973 | Larkin | |
| 3,973,281 A | * | 8/1976 | Davis et al. | 5/131 |
| 4,042,199 A | * | 8/1977 | Winkler | 248/188.8 |
| 4,319,370 A | | 3/1982 | Robinson | |
| 4,734,946 A | | 4/1988 | Saputo | |
| 4,970,743 A | | 11/1990 | Wride et al. | |
| 4,998,310 A | | 3/1991 | Olson | |
| 5,144,706 A | | 9/1992 | Walker | |
| 5,477,571 A | * | 12/1995 | Roggenkamp et al. | 5/310 |
| 5,564,140 A | | 10/1996 | Shoenhair et al. | |
| 5,688,287 A | | 11/1997 | Cline | |
| 5,743,672 A | | 4/1998 | Cline | |
| 5,953,775 A | * | 9/1999 | Mauro et al. | 5/201 |
| 6,216,289 B1 | * | 4/2001 | Woods | 5/200.1 |
| 6,338,172 B1 | | 1/2002 | Taylor et al. | |
| 6,557,191 B1 | * | 5/2003 | Bellows et al. | 5/200.1 |

FOREIGN PATENT DOCUMENTS

GB 2035078 A * 6/1980

* cited by examiner

*Primary Examiner*—Michael F. Trettel
(74) *Attorney, Agent, or Firm*—David J. McKinley; Oppenheimer Wolff & Donnelly LLP

(57) ABSTRACT

A bed foundation is provided which is constructed of blow-molded plastic and may be assembled without using tools. The components of the bed foundation all have lengths of less than 60 inches and may be packaged together in a container having a length less than 60 inches and a girth less than 84 inches, so as to avoid shipping penalties. The components are constructed and arranged to allow disassembly and storage when the foundation is not in use. One embodiment provides a bed foundation that, when assembled, has a top panel which overhangs the side rails to permit an oversized mattress to be placed thereon. Additionally, bed legs are provided that are configured to mate with contours in the foundation.

20 Claims, 17 Drawing Sheets

LEG AND BRACKET ASSEMBLY FOR A BED FOUNDATION

CROSS REFERENCE TO RELATED APPLICATIONS

This invention is a continuation-in-part of U.S. patent application Ser. No. 09/900,685 filed Jul. 6, 2001, now abandoned which is related to Provisional Application No. 60/216,908, filed Jul. 7, 2000, and are incorporated herein by reference in their entirety.

BACKGROUND OF THE INVENTION

Despite the remarkable advances made in manufacturing processes over the last several decades, conventional bed foundations have, for the most part, dated designs and are assembled using old techniques. These foundations, commonly known as box springs, consist of a plurality of wood members combined with rigid metal springs constructed and arranged to form a rectangular box which provides a relatively rigid platform on which to place a mattress. The bottom of the box spring or bed foundation, having rigid members, is capable of being supported by a bed frame having two side rails and one or two cross members.

Because these conventional bed foundations are assembled at the factory and covered with attractive ticking, they cannot be disassembled for shipping. If the manufacturer were to ship the parts of the box spring along with the cover and leave assembly up to the consumer, the consumer would likely not have the skill to properly construct the box spring. Therefore, box springs are shipped fully assembled despite the extra shipping costs charged for large packages, described in more detail below. These fully assembled box springs not only incur shipping penalties, they are difficult to handle, both during delivery to the consumer and by the consumer once in the consumer's home. For example, it is not uncommon, in the case of larger sized beds such as queen beds that a box spring is unable to fit up a stairwell or around certain corners. Thus, the bulky size of the box spring limits the number of rooms in which a homeowner can place a larger sized bed.

A few bed foundations have been conceived that may be reversibly assembled and are provided in components that can be conveniently stored and shipped prior to assembly at an end user's location. Several embodiments of such bed foundations are described in Walker, U.S. Pat. No. 5,144,706 and Shoenhair et al., U.S. Pat. No. 5,564,140, both of which are assigned to the assignee of the present application.

Walker describes a bed foundation that is assembled from several interlocking sections. The Walker bed foundation has two center sections that are shorter than the end sections so that the center sections may be packed within the end sections.

Shoenhair et al. discloses a bed foundation that is fabricated from a pair of side rails, a pair of end rails, at least one intermediate rail, and several top panels. When disassembled, the components of the Shoenhair et al. bed foundation are relatively flat to facilitate shipment of the bed foundation to customers.

United Parcel Service (hereinafter "UPS") has standards that provide a shipping surcharge if a container is too large in various dimensions. Shipping charges are based primarily on the weight but, in the case of large packages, also on the dimensions of the packages being shipped. UPS penalizes the shipper for containers that are large but relatively light in weight. The first surcharge called Oversized 1 (OS1) is defined as:

1. The package's combined length and girth exceeds 84 inches.

2. The packages' combined length and girth is equal or less than 108 inches.

3. The package's actual weight is less than 30 pounds.

Girth is defined as twice the width plus twice the depth of a package which has a length (or height when standing on end), a depth and a width where length is the greatest dimension. For each OS1 package, the billable weight is 30 pounds.

The second surcharge called Additional Handling, is applied to packages which exceed 60 inches in length. These packages are assessed an additional handling surcharge of $5.00 per package.

While these bed foundations provide a solution to the problem a conventional bed foundation poses pertaining to shipping a large, fully assembled box spring, these designs do require a significant amount of assembly by the consumer. Ideally, a bed foundation could be assembled without tools from components that can be packed into a standard sized container. Such a foundation would give a customer a good impression of the bed company once the customer gets the package home or has the package delivered and begins to assemble the bed. Assembly details are not easily shown in a retail setting. Bed foundations, or other products for that matter, requiring assembly, can often leave a bad impression with the customer if the assembly asked of the customer is excessive, complicated or poorly described in an instruction manual. Moreover, a kit requiring assembly and tools quite often contains a large number of screws, possibly a hexagonal wrench, a plurality of metal angle irons and corner pieces, and a plurality of wooden boards having holes already drilled at predetermined locations. It is not unusual for there to be screws missing, tools missing, holes drilled in the wrong location, and missing angle irons. These discrepancies can often create significant discontent with the customer and may even result in the customer returning the entire package and purchasing a competitor's product.

An additional problem presented by the traditional box spring is that it requires a steel rail frame assembly for supporting the box spring above the ground. These steel bed frames encounter many of the same shipping problems and expenses mentioned above. They consist of a plurality of angle irons pivotally attached to each other so that the frame may be somewhat folded for shipping. However, these angle iron pieces are unattractive and tend to damage the ticking of the box spring. Particularly unattractive are the wheeled leg members typically found on these frames. Besides being unattractive, the wheels make securing the bed in a desired location difficult and the angle iron legs can cause significant pain when kicked unintentionally.

Attempts have been made at designing wooden legs that bolt directly onto a box spring. These legs are problematic because conventional box springs are typically constructed of relatively thin pine members and do not exhibit the structural integrity required to be supported by only four, or even six, attachment points. Rather, these box springs are designed to be supported by a rail spanning substantially the entire length of the box spring.

BRIEF SUMMARY OF THE INVENTION

The present invention includes a bed foundation capable of supporting a variety of mattresses. Preferably, the bed foundation is constructed entirely of blow-molded plastic components. These components interlock without the use of tools and can be quickly and easily assembled by a customer.

When disassembled, the components compactly ship within a container having a length less than 60 inches and a girth less than 84 inches. When assembled, the bed foundation is inherently sturdy, attractive, and impressive.

The bed foundation generally comprises a pair of side rails, a pair of end rails, a plurality of intermediate rails, and top portions that lie upon, and interlock with the rail members. The side rails consist of two portions that disassemble to give the side rails an overall length of less than 60 inches.

One aspect of the invention is a bed leg constructed and arranged to be bolted to the bed foundation. The bed leg includes a top portion configured to mate with tack-offs of the side rails. The interference between the tack-offs and the top portion provides significant longitudinal strength. Lag bolts, or the like, may be used to maintain a close interference relationship between the leg and the side rails.

Another aspect of the invention is a mounting bracket for a headboard or a footboard. The bracket is attachable to the bed foundation using the fasteners for the bed legs. The bracket includes a horizontal piece that gets sandwiched between the foundation and the bed leg to provide additional support for the headboard or footboard.

DETAILED DESCRIPTION OF THE INVENTION

Figure 1:
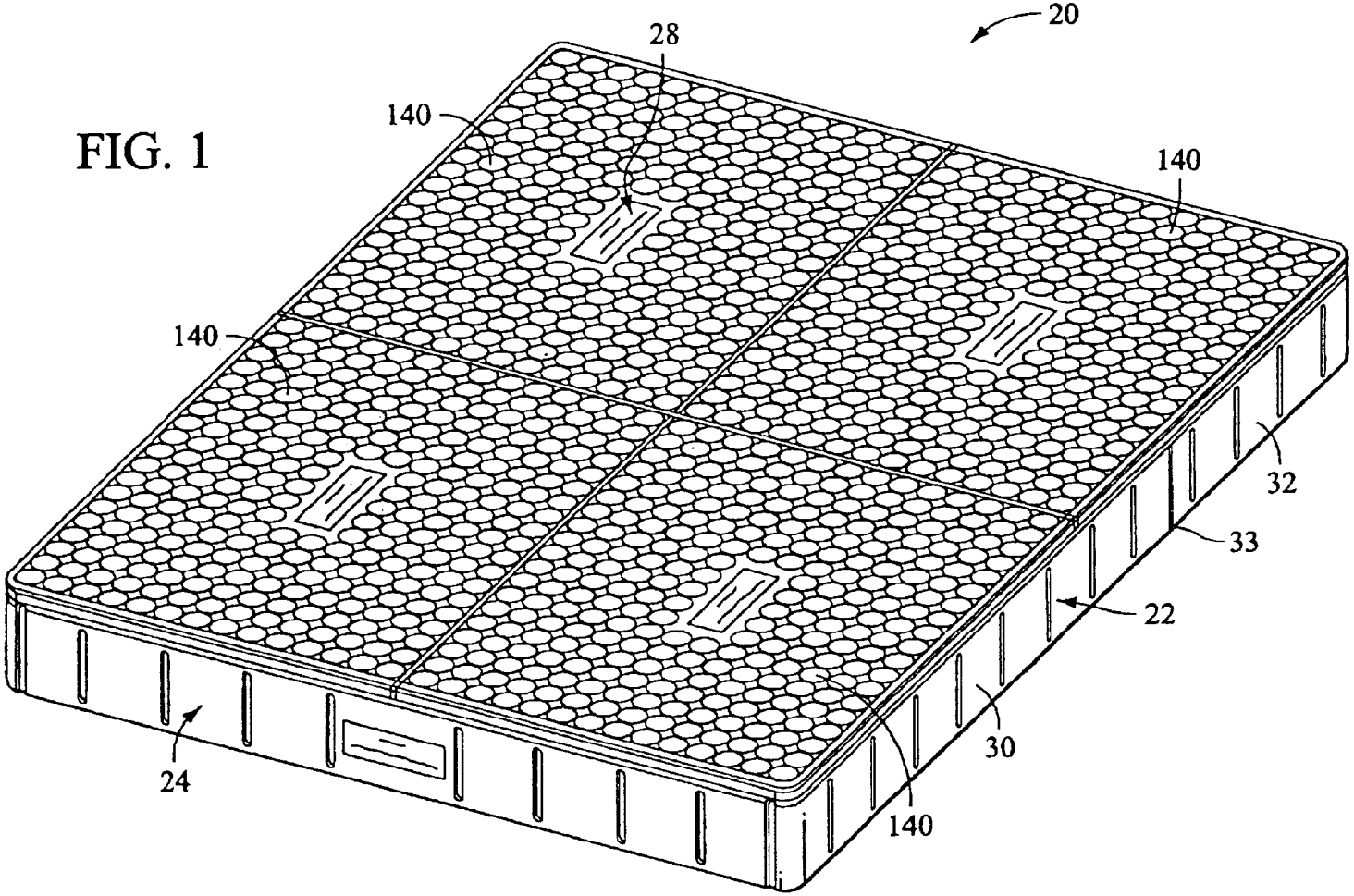
FIG. 1 is a perspective view of a bed foundation according to the present invention.
Figure 2:
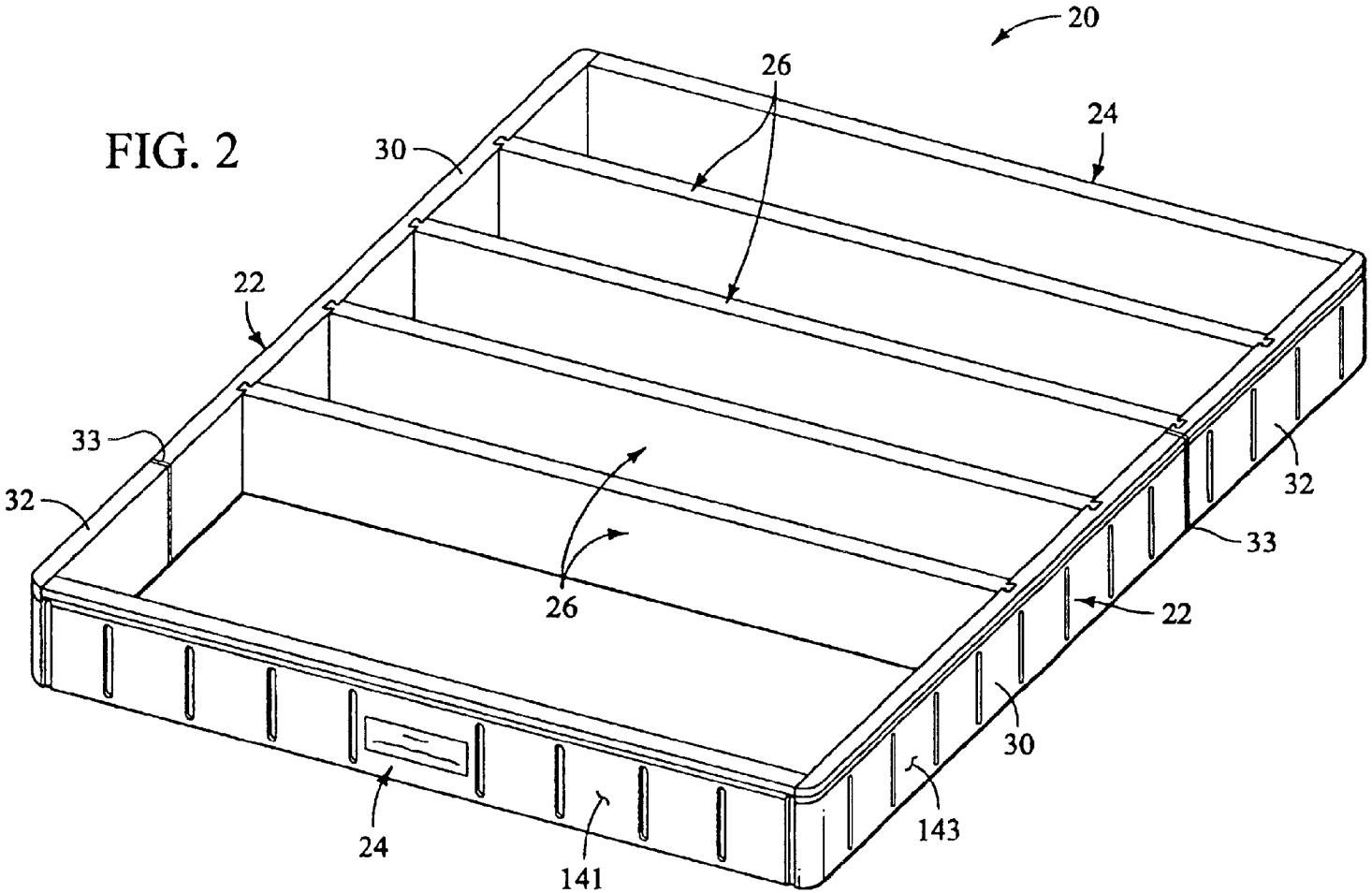
FIG. 2 is a perspective view of the preferred bed foundation with the top plate removed.

Referring now to the drawings in first to FIGS. 1 and 2, a bed foundation 20 is provided which includes a pair of side rails 22, a pair of end rails 24, at least one intermediate rail 26, and a top panel 28. The side rails 22, the end rails 24, the intermediate rails 26, and the top panel 28 are all preferably blow-molded from plastic.

The components of the bed foundation 20 permit reversible assembly so that the bed foundation 20 may be shipped to the customer in packages that do not incur sized-based penalties when shipping. The bed foundation 20 is constructed and arranged to permit the customer to assemble and disassemble the bed foundation 20 so it may be later stored in a relatively small space when a customer is not using the foundation 20.

The components of the foundation 20 include interlocking joints that enable the foundation 20 to be assembled without the use of tools. These interlocking joints are integrally molded with the components so that no other parts are required. While not necessary, the interlocking joints may be further secured with lock pins or similar devices.

The side rails 22, each include a first section 30 and a second section 32. The first and second sections, 30 and 32, are removably attachable to each other. When attached, the first section 30 is aligned with the second section 32 to form a straight, linear side rail 22. Notably, the first section 30 and the second section 32 are preferably of different lengths. The different lengths of the first section 30 and the second section 32 allow the resulting union 33 between the first section 30 and the second section 32 of each of the side rails 22 to be offset from the center of the bed foundation 20. In other words, the union 33 of one side rail 22 is closer to a head end of the side rail 22 whereas the union 33 of the other side rail 22 is closer to the foot end of that side rail 22. This is advantageous because when both side rails 22 are assembled and facing each other, the union 33 of one side rail 22 may be longitudinally displaced from the union 33 of the other side rail 22, thereby increasing the rigidity of the overall foundation 20. If the unions 33 of either side rail 22 directly faced each other, a line of instability in the bed foundation 20 would be created. It will be seen that sections 30 and 32 are asymmetric such that errors cannot be made in arranging the side rails 22, thereby ensuring that unions 33 do not face each other. This arrangement prevents the occurrence of a natural creasing point in the bed foundation 20. However, one of ordinary skill in the art will appreciate it that is possible to form the first section 30 and the second section 32 with approximately equal lengths without going beyond the concepts of the present invention.

Figure 3:
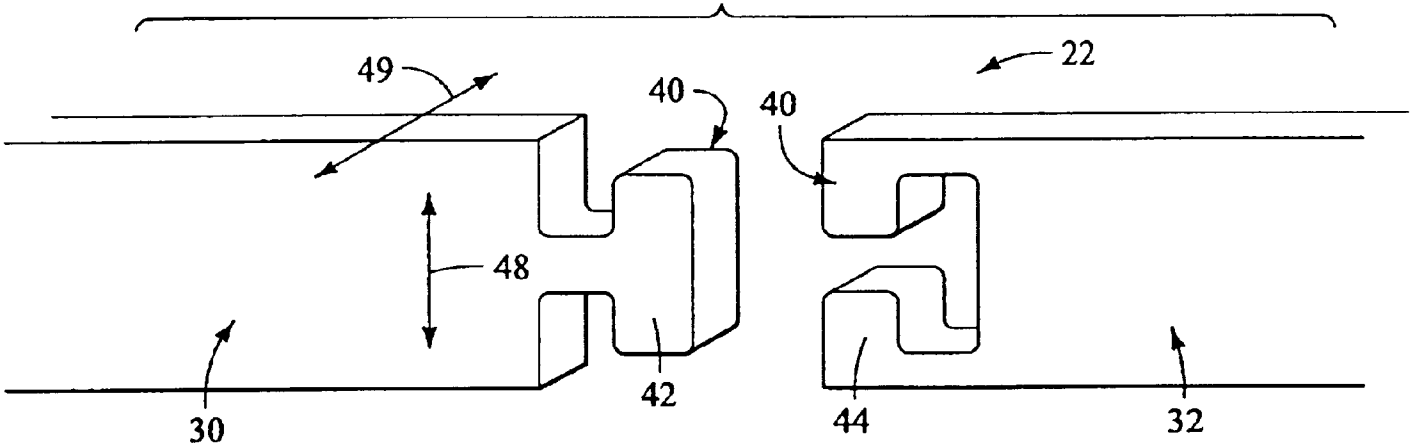
FIG. 3 is a perspective view of an embodiment of the side rail joint of the present invention in a disassembled state.
Figure 4:
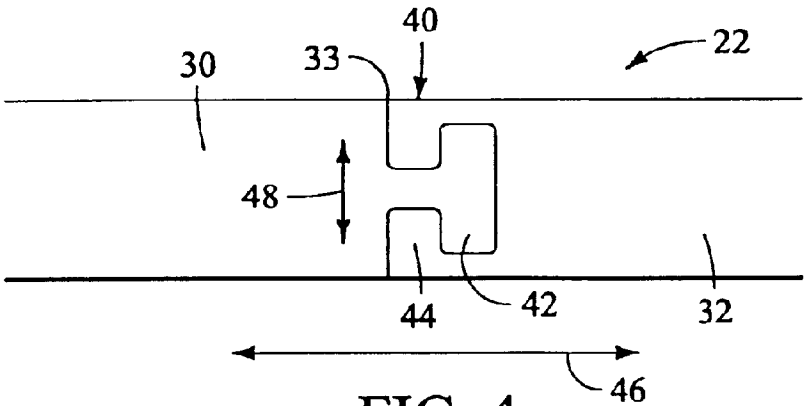
FIG. 4 is a side elevation view of the side rail joint of FIG. 3 in an assembled state.
Figure 5:
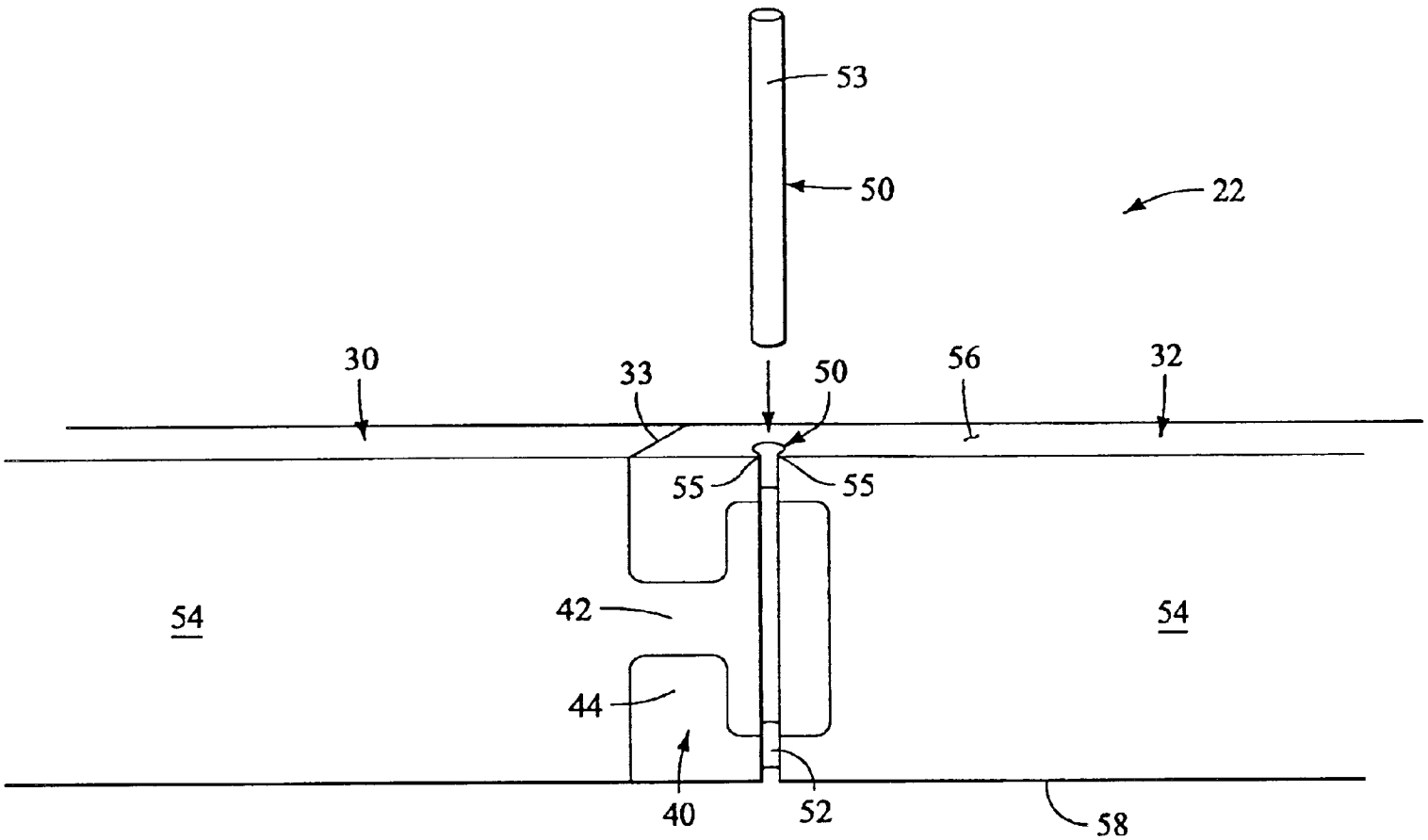
FIG. 5 is a perspective view of the side rail joint of FIG. 3 further having a locking mechanism.
Figure 6:
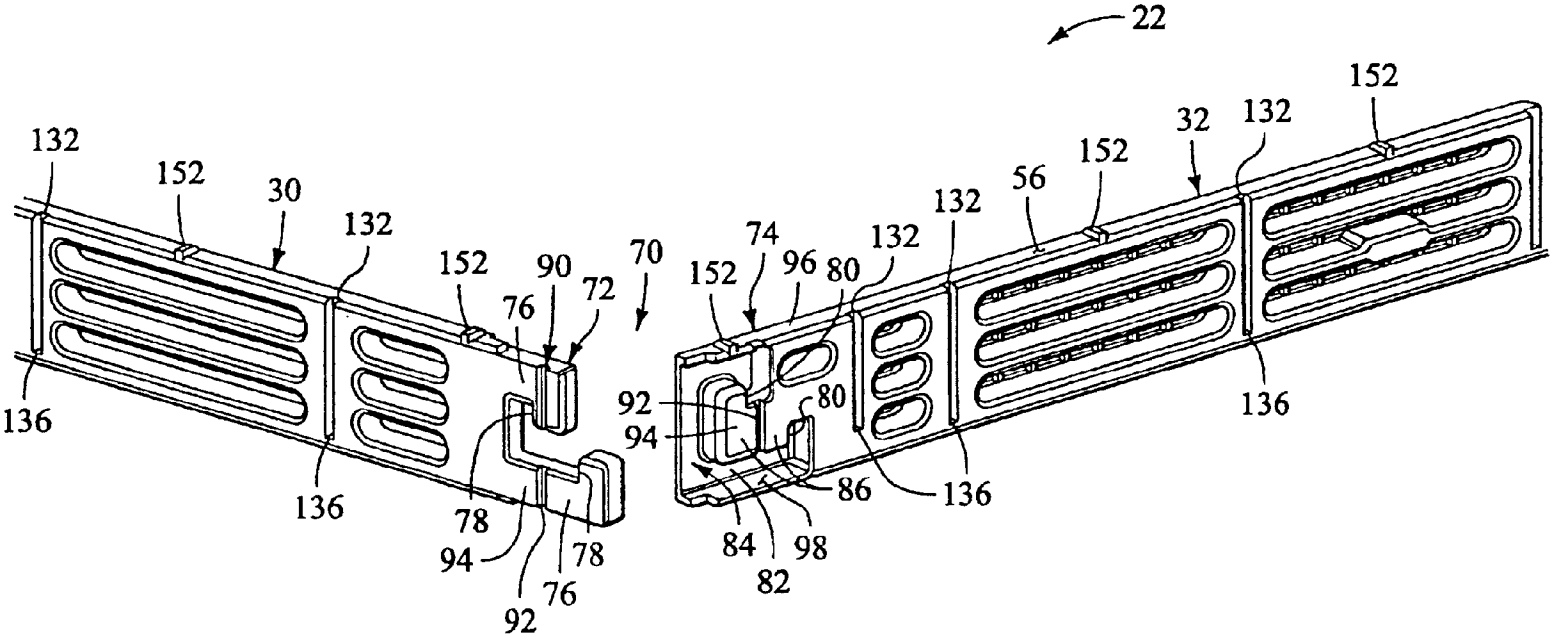
FIG. 6 is a perspective view of a preferred side rail joint of the present invention in a disassembled state.

Referring now to FIGS. 3–5, a mechanism is provided for reversibly joining the first section 30 and the second section 32. It can be seen that the T-joint 40 has an approximate T-shape and includes a male portion 42 extending from the first section 30 and a female portion 44 formed in the second section 32. The male portion 42 has a shape that is substantially complementary to the female portion 44 so that the male portion 42 and the female portion 44 form a snug, interlocking fit. One skilled in the art will understand that it is not important whether the female portion 44 be formed in the first section 30 or in the second section 32, only that one male portion 42 and one female portion 44 are provided and have complementary shapes.

The interlocking fit between the male portion 42 and the female portion 44 prevents the first section 30 from being pulled away from the second section 32, as indicated by arrow 46. The interlocking fit between the male portion 42 and the female portion 44 also prevents the first section 30 from moving up or down with respect to the second section 32 as indicated by arrow 48. The interlocking fit between the male portion 42 and the female portion 44 also resists lateral movement of the first section 30 with respect to the second section 32, as indicated by arrow 49 of FIG. 3. However, the resistance to this lateral movement, shown by arrow 49, results only from the friction between the first section 30 and the second section 32.

To further enhance the structural rigidity of the joint 40, and to prevent the lateral movement indicated by arrow 49, the joint 40 preferably includes a reinforcing mechanism 50, shown in FIG. 5. The reinforcing mechanism 50 maintains the first section 30 and the second section 32 in an assembled configuration, and preferably includes a slot 52 formed in a side surface 54 of the first section 30 and in the second section 32. The slot 52 preferably extends from a top surface 56 of the side rail 22 substantially to a bottom surface 58 of the side rail 22.

The slot 52 is adapted to receive a pin 53. The pin 53 has a profile that substantially conforms to a cross-section of the slot 52 such that the pin 53 fits snugly within the slot 52. The pin 53 is retained in the slot 52 by a pair of lips 55 that extend partially over the slot 52. The pin 53 is preferably fabricated from a metallic or plastic material.

Assembly is achieved by positioning the male portion 42 adjacent the female portion 44. The male portion 42 is then pressed into the female portion 44 until the male portion 42 engages the female portion 44. The pin 53 is then placed into the slot 52 locking the first section 30 and the second section 32 together. It may be preferable to provide more than one slot 52 and pin 53 to further enhance rigidity.

A more preferred mechanism for reversibly joining the first section 30 and the second section 32 is an L-hook joint 70 as seen in FIGS. 6–9. The L-hook has a male portion 72 and a female portion 74. The male portion 72 has at least one extension 76. Preferably, the male portion has two extensions 76. Preferably, at least one of the extensions 76 has a vertical catch 78, the function of which will be explained below.

The female portion 74 comprises a cavity 82 constructed and arranged to receive the male portion 72. The cavity 82 preferably does not pass through the side rail 22. Rather, the cavity 82 has a rear surface 84 and a plurality of complementary raised surfaces 86.

The male portion 72 and the female portion 74 fit together in a snug, interlocking manner when the extensions 76 are inserted into the cavity 82. The vertical catches 78 of the extensions 76 act on vertical surfaces 80 of the cavity 82. The relationship between the catches 78 and the vertical surfaces 80 prevent the first section 30 from being pulled away from the second section 32 in a longitudinal direction. This relationship also helps to prevent the first section 30 from being angled upwardly or downwardly in relation to the second section 32.

Figure 7:
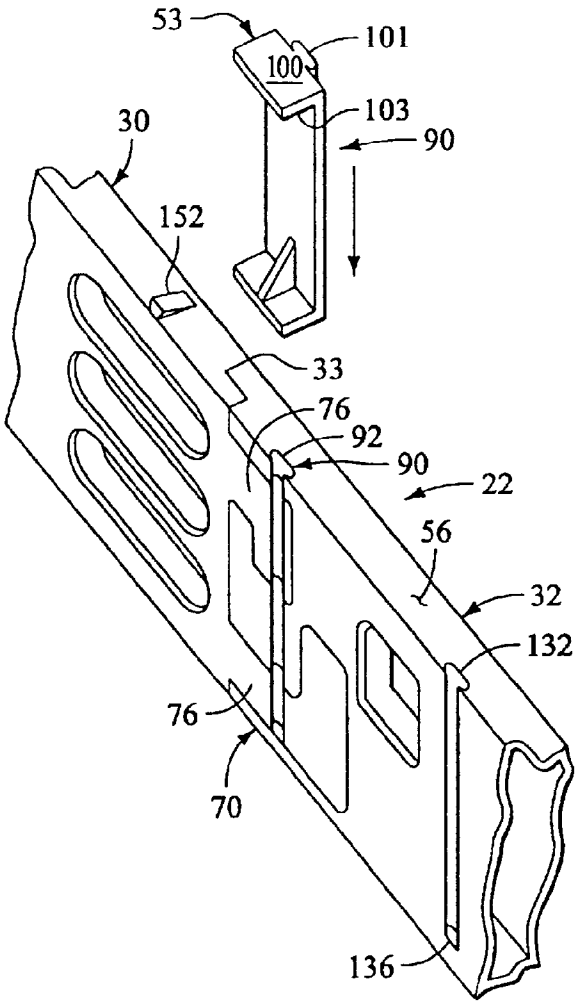
FIG. 7 is a perspective view of the preferred side rail joint of FIG. 6 shown in an assembled state.
Figure 8:
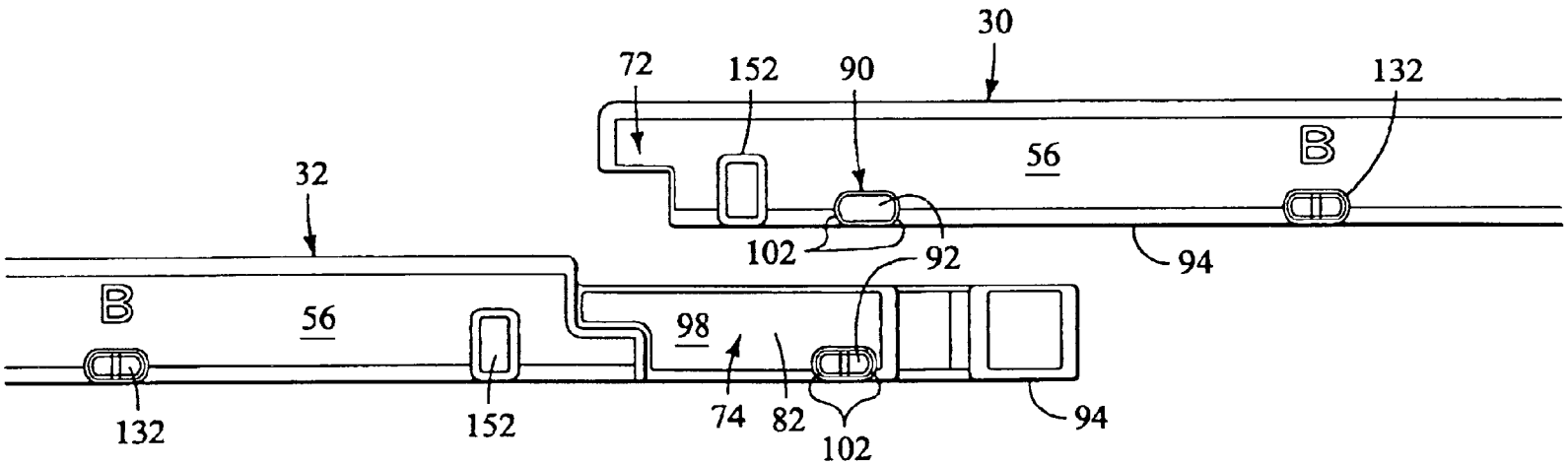
FIG. 8 is top view of the preferred side rail joint of FIG. 6 shown in a disassembled state.

To further enhance the structural rigidity of the joints 70, and to retain the first section 30 and the second section 32 in an assembled configuration, the joint 70 preferably includes a reinforcing mechanism 90, as seen in FIGS. 7–10. The reinforcing mechanism 90 preferably includes a slot 92 formed in a side surface 94 of the first section 30 and the second section 32. The slot 92 extends from the top surface 56 of second section 32 to the bottom surface 98 of the cavity 82 formed in the second section 32. FIG. 7 shows how the slot 92 is completed when the first section 30 and the second section 32 are assembled.

Figure 10:
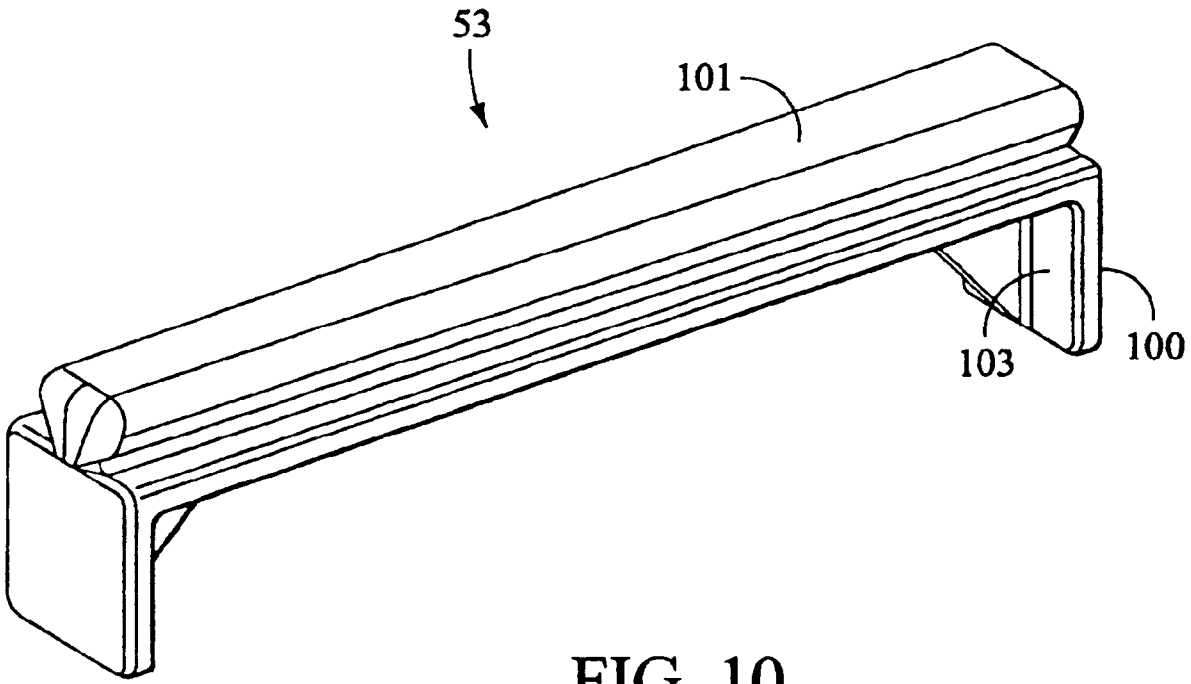
FIG. 10 is a perspective view of a preferred locking pin of the present invention.

The reinforcing mechanism 90 includes the aforementioned pin 53. The pin 53 is shaped to be received by the slot 92, and is preferably fabricated from a metallic or plastic material. The pin 53 is retained in the slot 92 by a pair of lips 102 that partially extend over the slot 92, as is most clearly illustrated in FIG. 8. FIGS. 7 and 10 show a preferred embodiment of the pin 53 used to retain the first section 30 and the second section 32 in an engaged relationship. It can be seen that the pin 53 includes a horizontal surface 100 on which to press when inserting the pin 53 into the slot 92. Integral with the horizontal surface 100, is a pin portion 101. The pin 53 also preferably provides a downward facing surface 103 under which a user's fingers may be placed in order to pull the pin 53 in an upward direction when disassembling the bed foundation 20.

Figure 13:
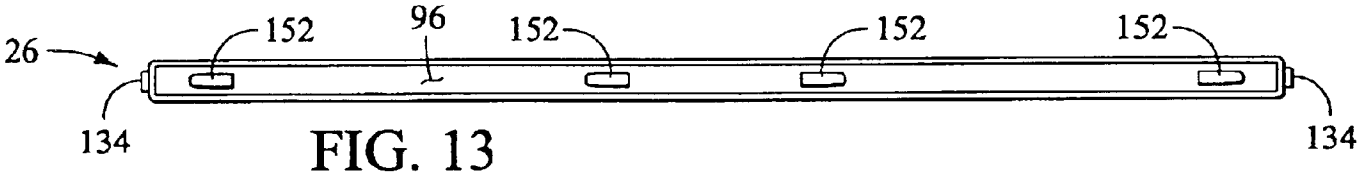
FIG. 13 is a top plan view of the intermediate rail of FIG. 11.
Figure 12:
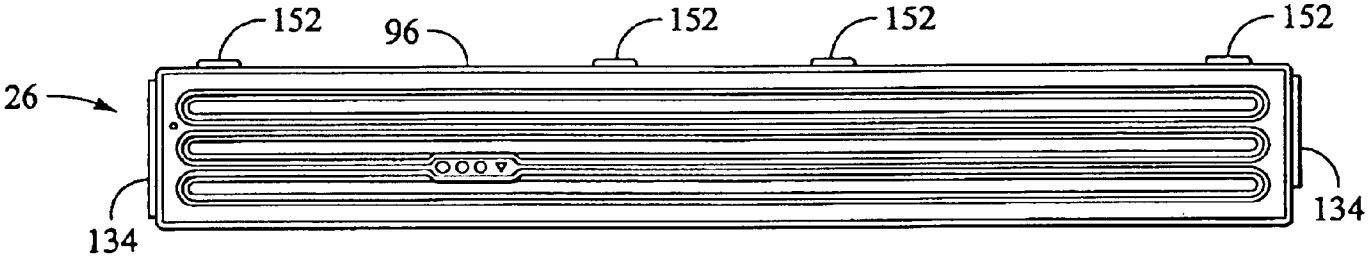
FIG. 12 is a side elevation of the intermediate rail of FIG. 11.
Figure 11:
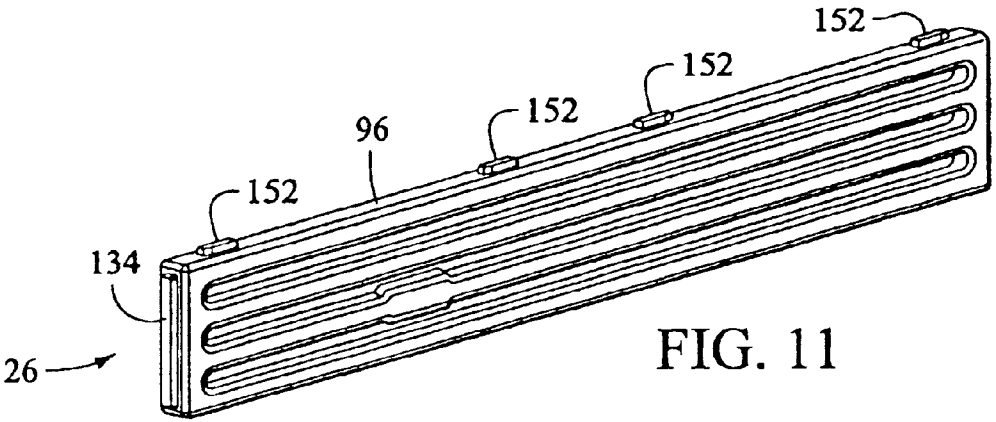
FIG. 11 is a perspective view of an intermediate rail of the present invention.
Figure 16:
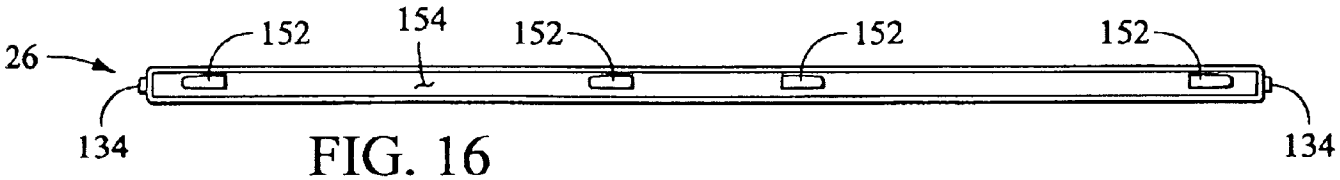
FIG. 16 is a top plan view of the end rail of FIGS. 14 and 15.

Referring now to FIGS. 11–13, the bed foundation 20 includes at least one, preferably four, intermediate rails 26 constructed and arranged to extend from one side rail 22 to the opposite side rail 22, between the end rails 24 (as seen in FIG. 2). The intermediate rails 26 thereby enhance the structural rigidity of the bed foundation 20. While the spacing between the intermediate rails 26 may be approximately equal, the intermediate rails 26 are preferably spaced so that all four intermediate rails are located in approximately a middle half of the bed foundation 20. Such a configuration provides additional support and helps to prevent deflection in a central region of the bed foundation 20 where a high concentration of a person's weight will be located while that person is lying on the bed.

Figure 9:
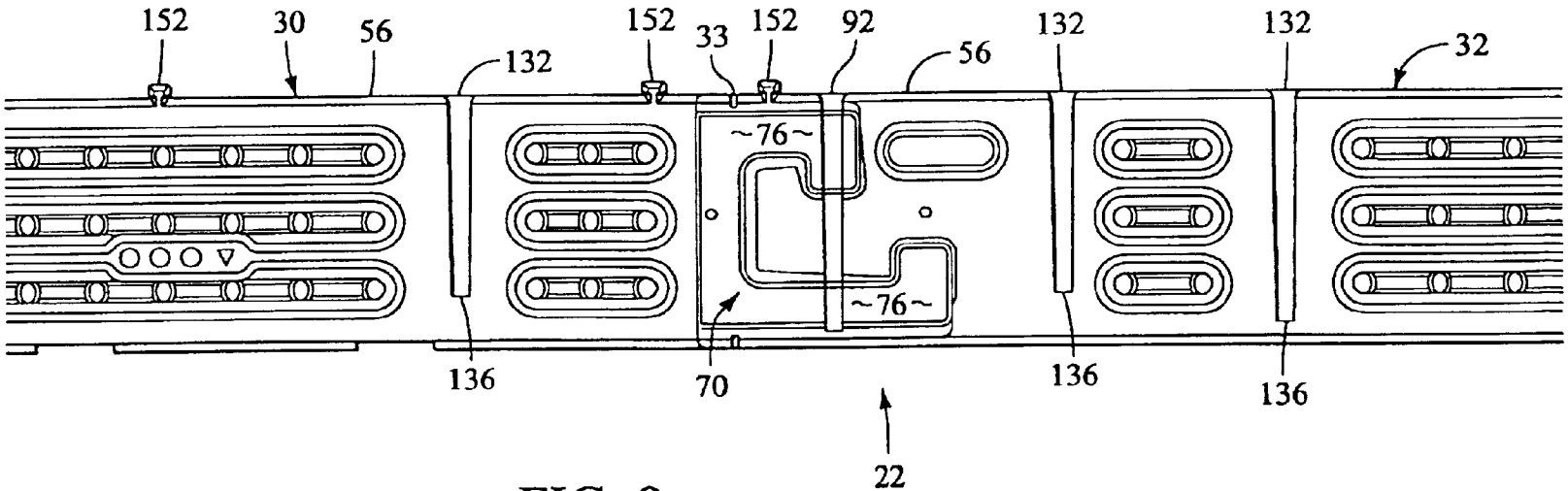
FIG. 9 is a side elevation of the preferred side rail joint of FIG. 6 shown in an assembled state.

To facilitate ease of assembly and disassembly of the bed foundation 20, without tools, the side rails include grooves 132 (FIGS. 6–9) defined therein. The grooves 132 are constructed and arranged to receive dovetails 134 which are integral with and extend from the ends of the intermediate rails 26. As seen in FIG. 9, the grooves 132 preferably extend from the top surface 56 of the side rail 22 to a stop 136 which is provided just above a lower surface 138 of the side rails 22. The stop 136 provides a positive indication that the dovetail 134 is completely inserted in the groove 132 and prevents the dovetail 134 from extending too far into the groove 132, resulting in the top surfaces of the intermediate rails 26 and the side rails 22 from being uneven.

Figure 15:
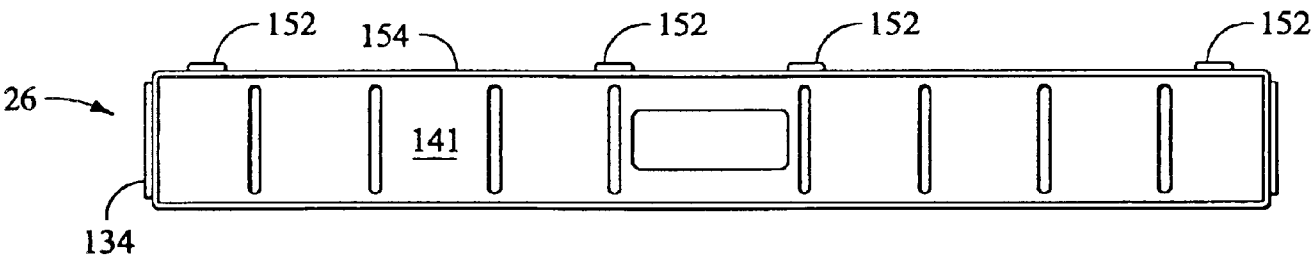
FIG. 15 is a side elevation of an end rail of the present invention showing the outer side.
Figure 14:
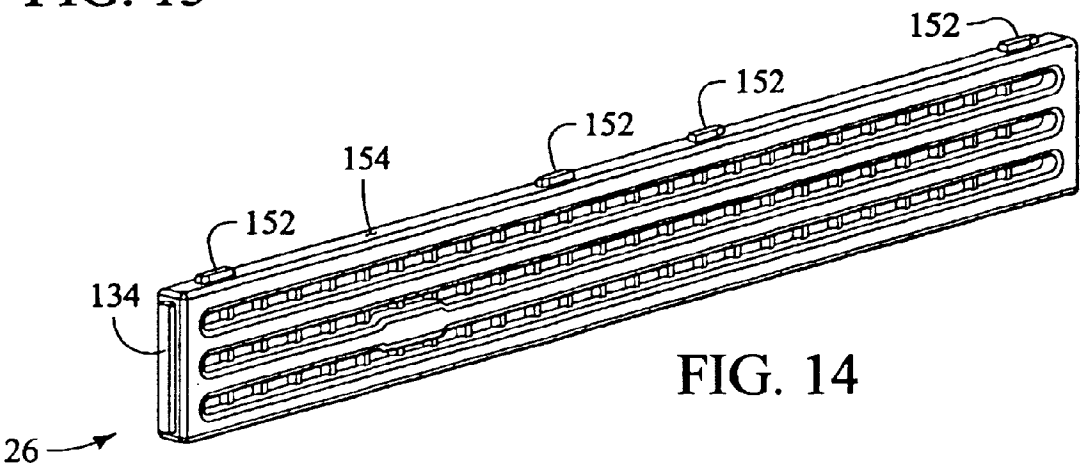
FIG. 14 is a perspective view of an end rail of the present invention showing the inner side.

As seen in FIGS. 13–15, the end rails 24 connect to the side rails 22 in the same manner as the intermediate rails 26. Structurally, the only difference between the end rails 24 and the intermediate rails 26 is the appearance of an outside surface 141. Preferably, the outside surface 141 is ornamentally similar to the outside surfaces 143 (FIG. 1) of the side rails 22 such that when the bed foundation 20 is fully assembled, an attractive, completed appearance results.

Figure 17:
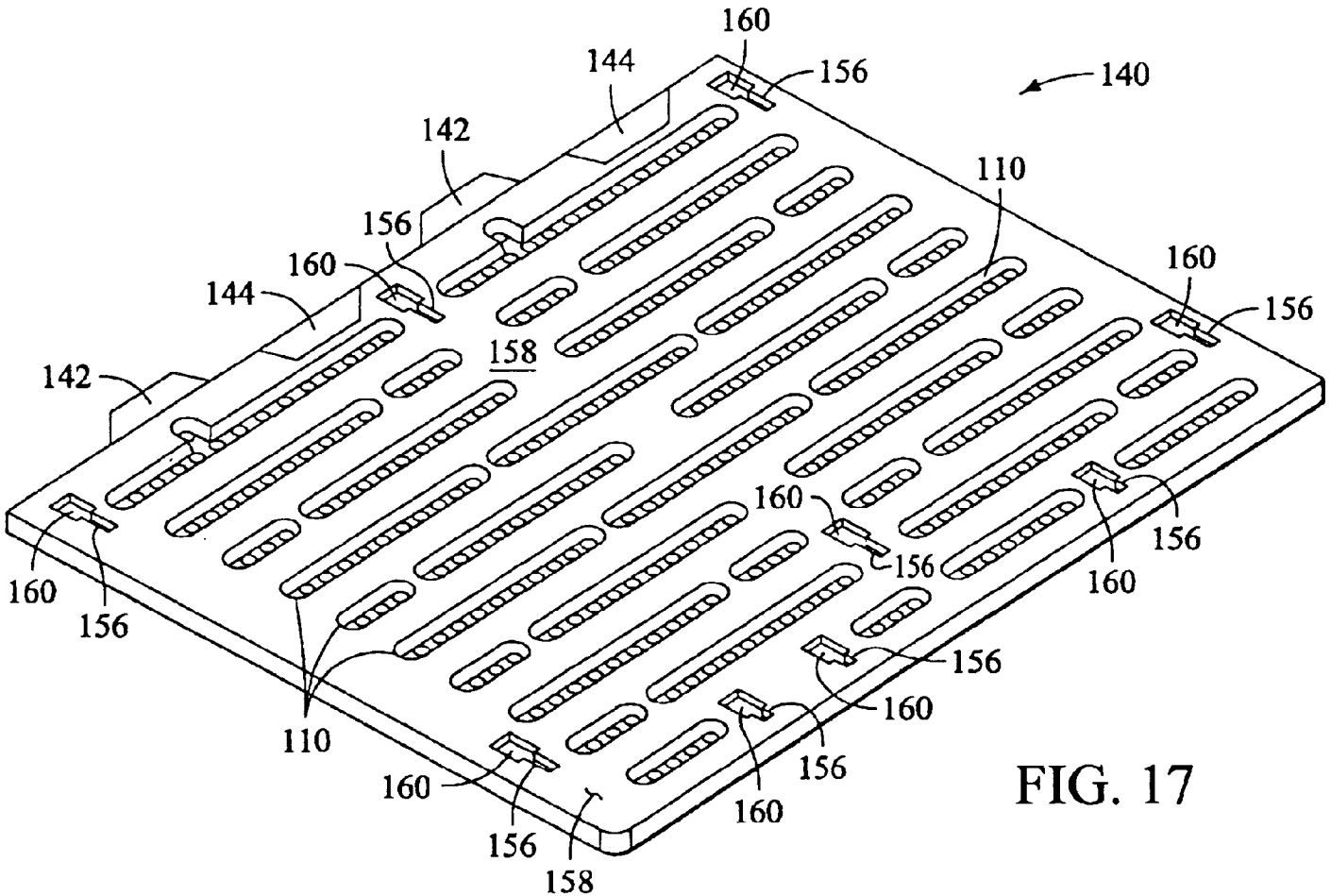
FIG. 17 is a perspective view of a top panel portion of the present invention which has been inverted to show the detail of the lower surface.

As shown in FIGS. 1 and 17, the bed foundation 20 further includes a top panel 28 constructed and arranged to extend over the side rails 22, the end rails 24, and the intermediate rail 26 when placed thereon. The top panel 28 substantially covers an area defined by these components. An alternate embodiment provides a top panel 28, which extends a predetermined distance past the side rails 22. Such an embodiment allows a larger mattress to be placed on a smaller bed foundation 20. This is especially useful with the recent introduction of the deluxe queen, a new size being introduced by mattress manufacturers to provide a queen sized bed which is three inches wider than a convention queen sized bed. This larger top panel 28 obviates the need for a consumer to buy a new bed foundation or box spring and, more importantly, obviates the need for a new bed frame.

To facilitate storing and shipping the bed foundation 20, the top panel 28 is preferably formed of multiple top panel portions 140. Each of the top panel portions 140 preferably has a common shape. It is envisioned that queen and king sized foundations 20 will have four top panel portions 140 while twin sized and double sized foundations 20 will have two top panel portions 140.

To facilitate mounting the top panel portions 140 in a desired position with respect to each other, the top panel portions 140, each include at least one tab 142 extending from a side of the top panel portion 140 and a recess 144 formed in the side of top panel portion 140, as most clearly illustrated in FIG. 17. The tabs 142 preferably have a shape that substantially conforms with a shape of the recess 144. It is envisioned that the top panel portions 140 include two tabs 142 and two recesses 144, which permit all of the top panel portions 140 to have a substantially uniform configuration.

The top panel portions 140 further include a mounting mechanism, which secures the top panel portions 140 to the side rails 22, the end rails 24, and the intermediate rails 26. The mounting mechanism preferably includes a locking extension 152 formed on the top surfaces 56 of the side rails 22, the top surfaces 96 of the intermediate rails 26 (FIGS. 6–9 and 11–16), and the top surfaces 154 of the end rails. It is understood that the number and size of the locking extensions 152 are selected based upon the size of the foundation 20. A person of ordinary skill of the art will appreciate that a greater number of locking extensions 152 would be beneficial on a king-sized foundation than would be on a twin sized foundation.

Figure 19:
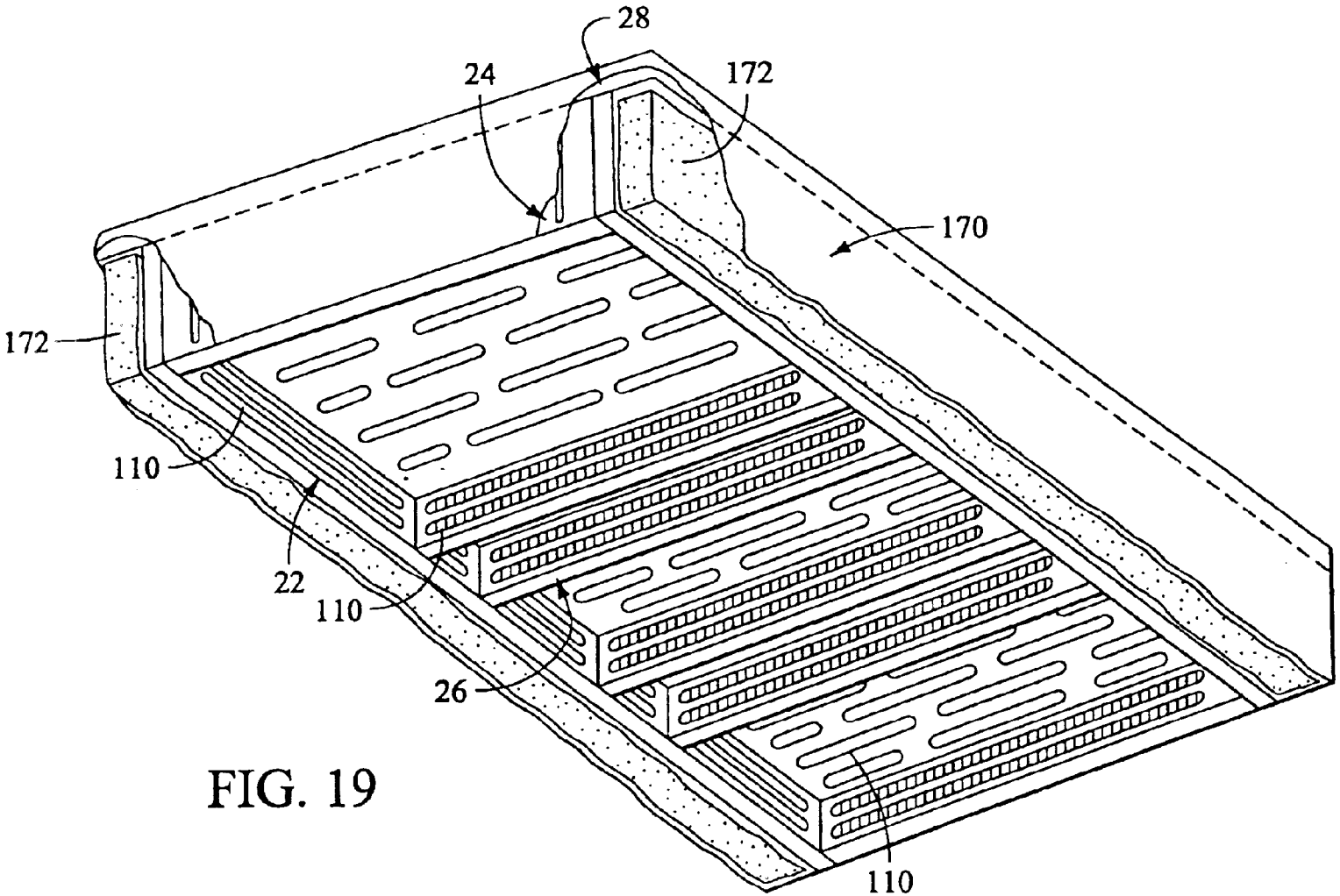
FIG. 19 is a perspective view of the bottom of a preferred embodiment having an overhanging top panel and a cover with filler foam.
Figure 20:
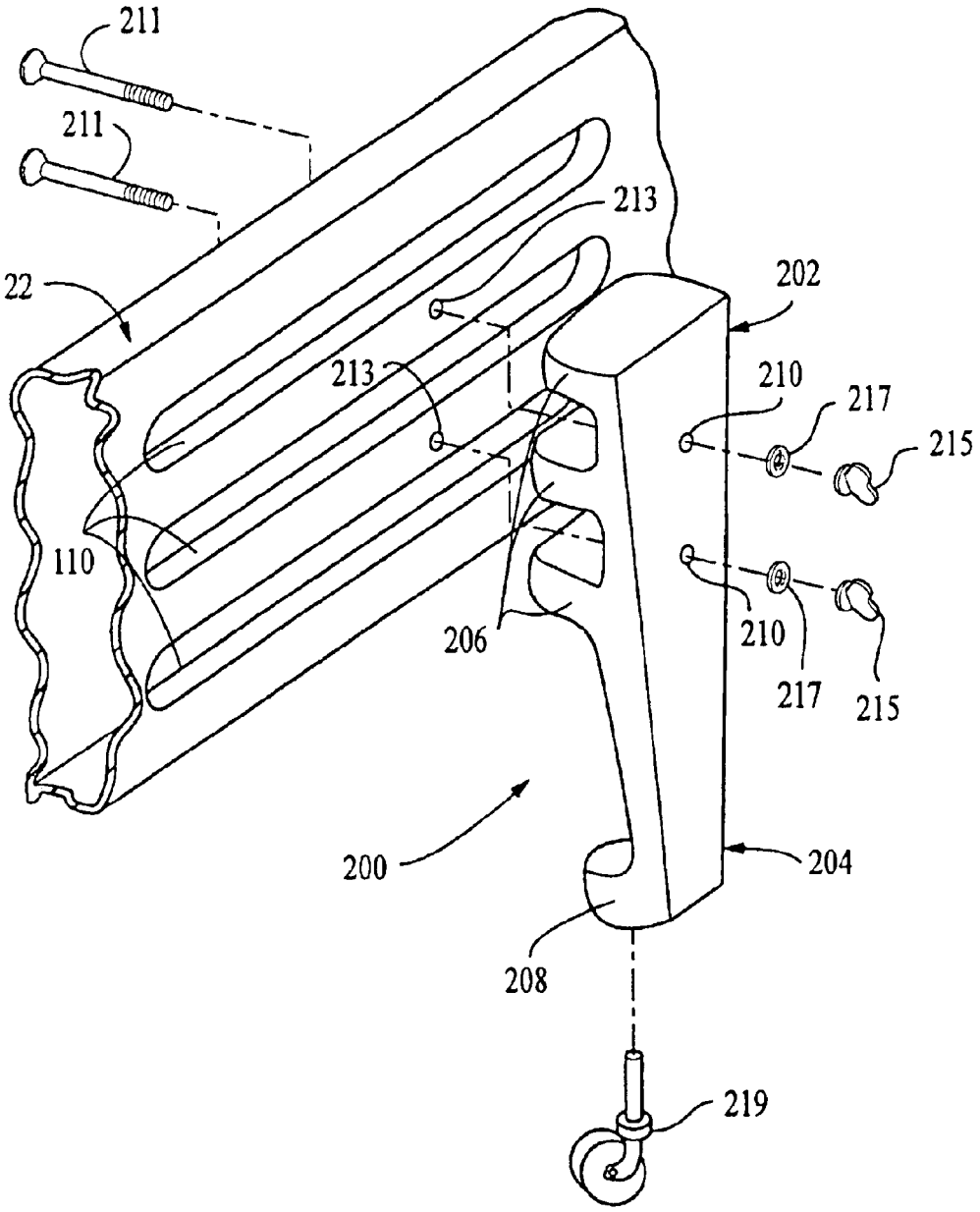
FIG. 20 is a perspective view of a bed leg of the present invention.

A receiving portion 156 is formed into a lower surface 158 of the top panel portions 140, as seen in FIGS. 19 and 20. To facilitate insertion of the locking extension 152 into the receiving portion 156, a recess 160 is preferably formed in the lower surface 158 of the top panel portions 140 adjacent the receiving portions 156.

The side rails 22, the end rails 24, the intermediate rails 26, and the top panel 28 are each preferably fabricated from plastic, more preferably injected-molded plastic, even more preferably blow-molded plastic. Using blow-molded plastic is advantageous, not only because it allows complete recyclability, but also because it minimizes material costs. Also, once tooling is established, blow molding minimizes production costs and allows parts to be produced having complicated geometries. A person of ordinary skill in the art will appreciate that it is possible to fabricate the preceding components from a variety of materials, such as steel or wood, using the concepts of the present invention. However, doing so would result in increased production costs.

To further enhance the structural rigidity of the blow-molded plastic components, tack-offs 110 are incorporated into the shape of the top panel portions 140, the side rails 22, the end rails 24, and the intermediate rails 26. The tack-offs 110 are simply indentations formed in a surface or two surfaces of a component. Tack-offs 110 are well known in the art and commonly used with blow-molded plastic components in order to increase rigidity. The tack-offs 110 may be created with a wide variety of dimensions and may range from deep to shallow and from long to short. The tack-offs 110 may be formed in either a vertical orientation, or a horizontal orientation. Preferably, the intermediate rails 26, have tack-offs 110 running horizontally substantially the entire length of the intermediate rail 26. The tack-offs 110 formed in the side rails 22 are preferably positioned so as not to interfere with the grooves 132, or the slots 92.

Figure 18:
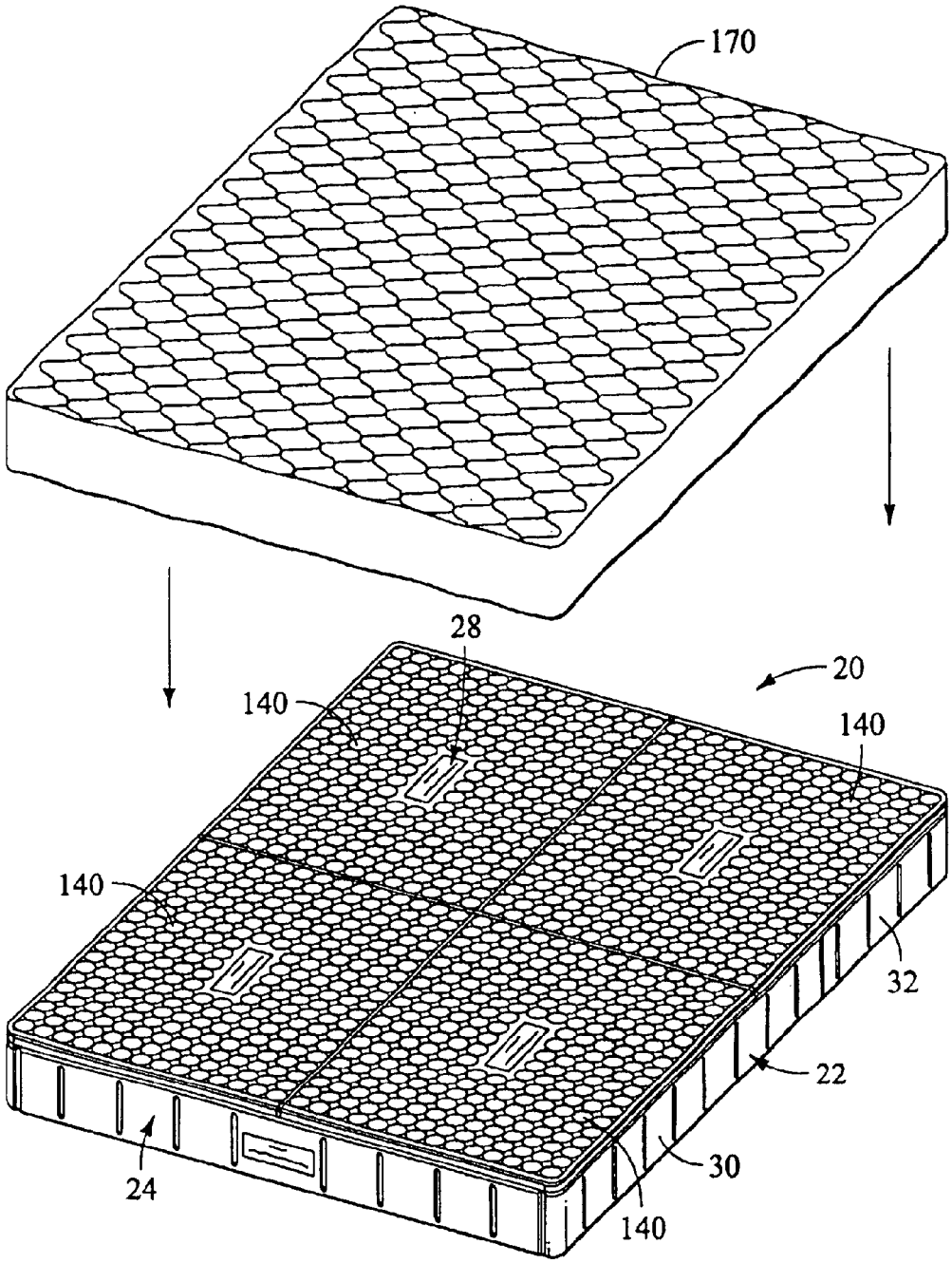
FIG. 18 is a perspective view of a cover of the present invention.

The bed foundation 20 further includes a substantially decorative cover 170 shown in FIG. 18. The cover 170 extends over the entire outer surface of the bed foundation 20. The cover is preferably fabricated from a cloth material and enhances the aesthetic appeal of the bed foundation by providing the bed foundation 20 with an appearance that is similar to the appearance of box springs used with conventional mattresses. For the embodiment providing a top panel 28 that extends over the side rails 22 to provide support for an oversized mattress, shown in FIG. 19, a cover 170 may be provided with filler foam 172 which fills in the resulting space formed between the sides of the overhanging cover and the side rails 22 of the foundation 20. This will give a rectangular, box-like appearance to the foundation 20, as opposed to a ledged appearance created by the overhanging top panel 28.

The bed foundation 20 of the present invention therefore provides an alternative to a conventional bed foundation. The bed foundation 20 may be disassembled so that its components may be packaged into standard sized shipping containers, e.g., shipping containers having a length of less than 60 inches and a girth of less than 84 inches. Using standard sized shipping containers enables the bed foundation 20 to be readily transported using common carriers without incurring additional charges associated with oversized packages. Furthermore, standard sized shipping containers also facilitate easy handling by customers.

Once the bed foundation 20 has been shipped to a customer in standard sized containers, the customer may easily assemble the bed foundation 20 without the use of any tools. The assembly process is straightforward. The side rails 22 are assembled first by joining the first sections 30 to the second sections 32. The first section 30 and the second section 32 are joined by placing the male portion 72 into the female portion 74. This is most easily accomplished by laying the second portion 32 on its side on the floor, such that the female portion 74 faces upward. The extension 76 of the male portion 72 is then pressed into the cavity 82 and may be stepped on to ensure a snug fit. A pin 53 is then placed into the groove 92 by pushing on the upper surface 100. Having assembled two side rails 22, the side rails 22 are then positioned such that they form a relative parallel relationship and such that pins 53 are facing each other, though longitudinally off-set. The end rails 24 are then placed between the side rails 22 and their dovetails 144 are positioned in the grooves 132. The two end rails 24 and side rails 22 should now form a rectangular shape. The intermediate rails 26 are placed in a similar fashion between the end rails 24 so that they span across the side rails 22. Their dovetails 134 are pressed into the corresponding grooves of the side rails 22. The top panel portions 140 are then attached to the assembly by placing the locking extensions 152, which extend from the side rails 22, the end rails 24, and intermediate rails 26 into the receiving portions 156 formed in the lower surface 158 of the top panel portions 140. This is most clearly seen in FIGS. 19 and 20. Once the top panel portions 140 are attached to the assembly, the cover 170 is simply placed over the top of the now assembled bed foundation 20.

With the assembly of the bed foundation 20 complete, the bed foundation 20 may be positioned to support virtually any type of mattress, e.g., a standard coil spring mattress, a fluid filled mattress, a futon, etc. Additionally, the bed foundation 20 may be placed atop, and supported by, a standard metal bed frame or may be placed atop and supported by a slat bed frame. Similarly, if desired, the bed foundation 20 may be placed atop and supported by a platform bed frame.

Preferably, the bed foundation 20 is supported by legs 200 of the present invention, as seen in FIG. 20. The bed leg 200 has an upper portion 202 and a lower portion 204. The upper portion 202 includes at least one tongue 206 configured to mate with one of the tack-offs 110 of the side rails 22 or the end rails 24. Preferably there is one tongue 204 provided for each of the tack-offs 110, thereby maximizing the structural interaction between the side rail 22 and the bed leg 200.

The lower portion 204 of the bed leg 200 forms a foot 208. The foot 208 reduces the pressure the bed places on a supporting surface, thereby protecting flooring materials. Alternatively, a caster 219 may be attached to the lower portion 204 of the bed leg 200 if a rolling capability is desired.

The bed leg 200, like the foundation 20, is preferably constructed of blow molded plastic. Blow molding allows precisely repeatable dimensions, thereby ensuring a predictable fit between the leg tongues 206 and the tack-offs 110. Blow molding also reduces the weight of the leg 200 without sacrificing strength. To increase the strength the interaction between the tongues 206 and the tack-offs 110, holes 210 are provided that align with corresponding holes 213 in the side rail 22. These holes accommodate a lag bolt 211, screw, or similar device useable to hold the leg 200 against the side rail 22. Preferably a wing nut 215 and washer 217 are provided such that tools are not required to assemble the bed frame 20.

Figure 21:
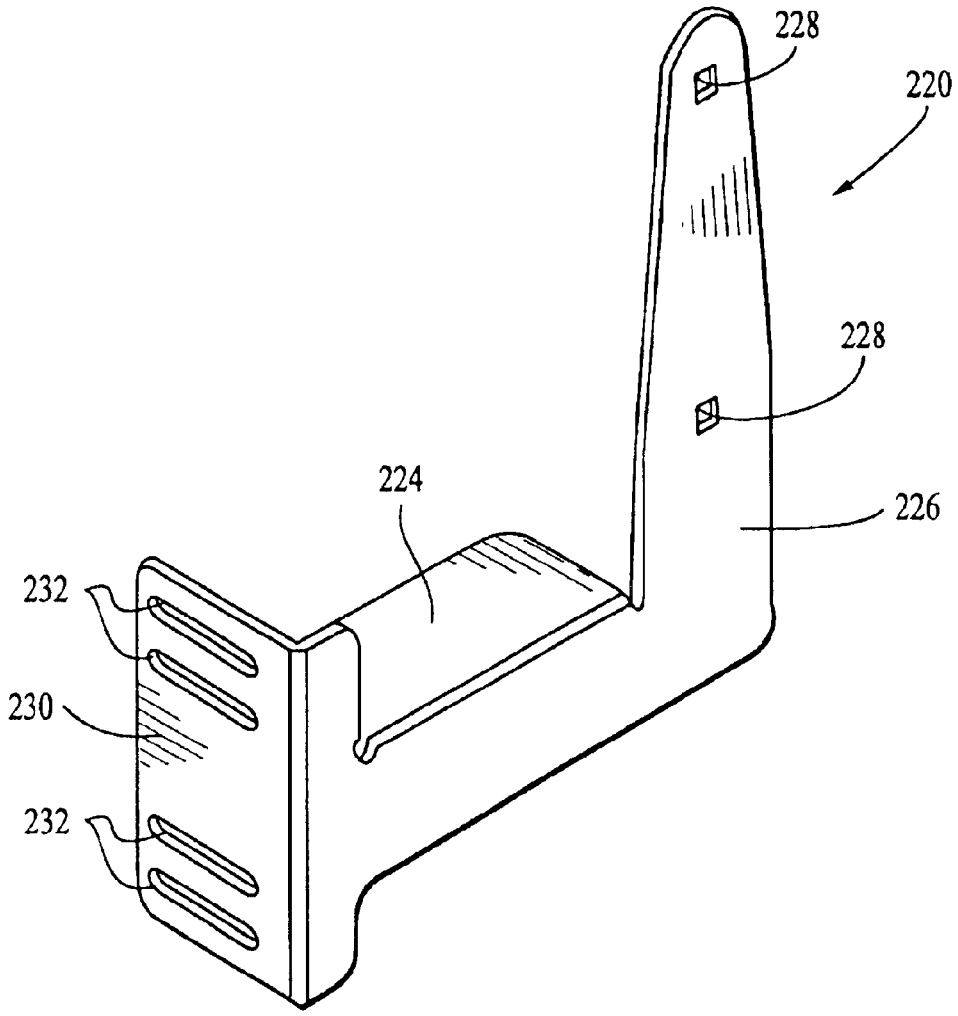
FIG. 21 is a perspective view of a headboard/footboard bracket of the present invention; and, FIG. 22 is a perspective view of the headboard/footboard bracket of FIG. 21 attached to a foundation of the present invention.
Figure 22:
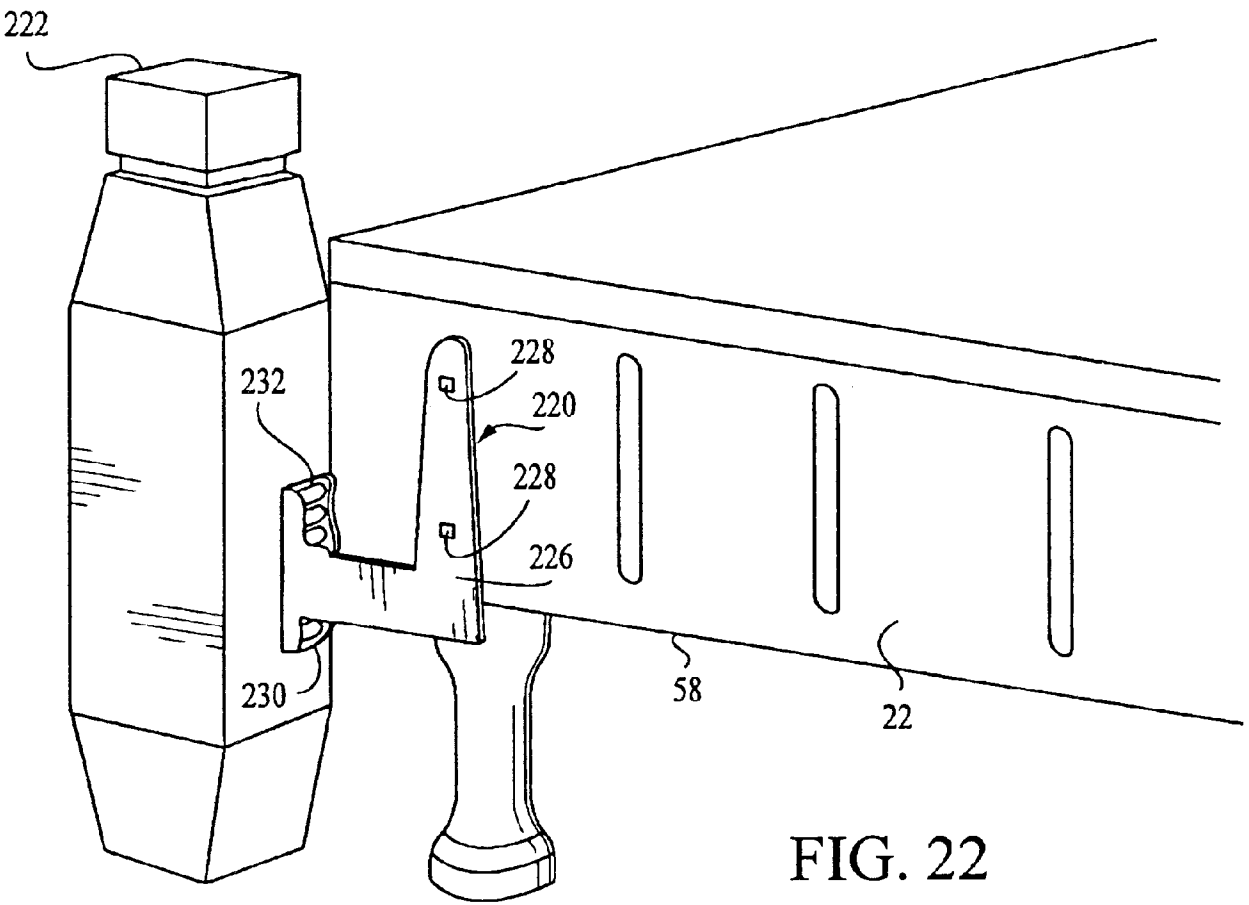

FIGS. 21 and 22 show a headboard/footboard bracket 220 that is useable to attach a decorative footboard 222 or headboard (not shown) to the bed foundation 20. The bracket 220 is preferably of unitary construction and includes a horizontal plate 224 that extends from a vertical plate 226. The vertical plate 226 defines two mounting holes 228 that are arranged to align with the holes 210 of the legs 200 and the corresponding holes 213 in the side rail 22. This hole arrangement allows the lag bolts 1211 used to hold the leg 200 against the inside of the side rail 22 to also be used to secure the bracket 220 to the outside of the side rail 22, thereby minimizing parts.

When the bracket 220 is attached to the side rail 22, the horizontal plate 224 gets sandwiched between the bottom surface 58 of the side rail 22 and the bed leg 200. The horizontal plate 224, thus, greatly increases the ability of the bracket 220 to support the footboard 222, and relieves stress from the vertical plate 226.

An attachment plate 230 also extends from, and is preferably integral with, the vertical plate 226. The attachment plate 230 includes a plurality of mounting slots 232, to which a variety of footboards 222 or headboards (not shown) may be attached. Preferably, these slots 232 assume a somewhat conventional configuration to make the bracket 220 accepting of a wide variety of footboards and headboards.

It is contemplated that features disclosed in this application, as well as those described in the above applications, incorporated by reference, can be mixed and matched to suit particular circumstances. Various other modifications and changes will be apparent to those of ordinary skill in the art without departing from the spirit and scope of the present invention, which is defined by the following claims.

What is claimed is:

1. A bed leg, useable to support a bed foundation, comprising:

an upper portion having at least one tongue configured to mate with a groove in the bed foundation;

a lower portion extending downwardly from said upper portion; and, a foot operably attached to a bottom of said lower portion;

wherein said tongue is configured to mate with a groove formed as a tack-off in said bed foundation.

2. The bed leg of claim 1 further comprising blow molded plastic.

3. The bed leg of claim 1 wherein said upper portion defines at least one hole sized to accept a fastener useable to secure said bed leg to the bed foundation.

4. The bed leg of claim 1 wherein said foot comprises a caster operably attached to said lower portion.

5. In combination with a blow-molded bed foundation having rail members with tack-offs formed therein, a bed leg comprising:

an upper portion having at least one tongue configured to mate with a tack-off formed in a rail member of a bed foundation;

a lower portion extending downwardly from said upper portion; and, a fastener connecting said bed leg to said rail member.

6. A bed foundation that is capable of supporting a bed, the bed foundation comprising:

a pair of side rails that each include a first section and a second section, wherein the first section and the second section engage each other so that the section is aligned with the second section;

a pair of end rails, wherein opposite ends of the side rails engage opposite ends of the end rails so that the side rails are parallel to each other and so that the end rails are parallel to each other; and, a plurality of bed legs, each leg attached to one of said rails, said bed legs each having an upper portion configured to mate with one of said end rails;

a top panel attachable to said rails and constructed and arranged to cover an area defined by said side rails and said rails;

wherein said rails further include tack-offs formed therein that enhance the structural rigidity of said side rails and said bed leg upper portions include tongues configured to mate with said tack-offs.

7. A bed foundation that is capable of supporting a bed, the bed foundation comprising:

a pair of side rail that each include a first and a second section, wherein the first section and the second section engage each other so that the first section is aligned with the second section;

a pair of end rails, wherein opposite ends of the side rails engage opposite ends of the end rails so that the side rails are parallel to each other and so that the end rails are parallel to each other; and, a plurality of bed legs, each leg attached to one of said rails, said bed legs each having an upper portion configured to mate with one of said rails, and wherein said bed leg upper portions are attached to said rails with a fastener;

a top panel attached to said rails and constructed and arranged to cover an area defined by said side rails and said end rails; and at least one mounting bracket comprising:

a vertical plate defining a mounting hole through which said fastener passes;

a horizontal plate, integral with the vertical plate, and sandwiched between the bed leg and a bottom surface of the side rail.

8. A method of assembling a bed foundation without using tools comprising:

engaging a first rail section to a second rail section to form a first side rail having a head end and a foot end;

engaging a third rail section to a fourth rail section to form a second side rail having a head end and a foot end;

connecting the first and second side rail head ends with an end rail spanning between said side rails;

connecting the first and second side rail foot ends with an end rail spanning between said side rails; and, attaching a plurality of legs to said rails by mating an upper portion of each of said legs with tack-offs formed in said rails.

9. The method of claim 8 further comprising using a fastener to fix said legs to said rails, such that a mating relationship between said upper portions of said legs and said corresponding structures is maintained.

10. The method of claim 8 wherein attaching a plurality of legs to said rails comprises attaching a plurality of legs to said side rails.

11. The method of claim 8 wherein attaching a plurality of legs to said rails comprises attaching a plurality of legs to said end rails.

12. The method of claim 10 further comprising attaching at least one mounting bracket to each of said side rails such that a horizontal plate is sandwiched between a bottom surface of said side rail and said bed leg.

13. The method of claim 12 further comprising aligning holes formed in each of said bed leg, said side rail, and said mounting bracket, with each other, and placing a fastener through said holes.

14. A bed foundation capable of being shipped in a container having a length not greater than 60 inches and a girth not greater than 84 inches said bed foundation comprising:

a pair of side rails each comprised a first section and a second section joinable to said first section, wherein said first and second sections are constructed and arranged such that when said first and second sections are unjoined said first and second sections are containable within said container, and when said first and second sections are joined, said side rail is not containable within said container, said side rails including tack-offs formed therein for adding rigidity to said side rails;

a pair of end rails engageable with said side rails, said end rails containable within said container; and, a plurality of bed legs, each having an upper portion configured to mate with the tack-offs formed in said rails.

15. The bed foundation of claim 14 further comprising a plurality of mounting brackets, each of said mounting brackets having a horizontal surface constructed and arranged to be sandwiched between the bed leg and a bottom surface of the side rail.

16. A bed foundation comprising:

a plurality of rail members constructed of blow-molded plastic, each of said rail members having:

a top surface;

a bottom surface;

two side surfaces;

two end surfaces;

a dovetail extending from at least one of said end surfaces;

a plurality of attachment tabs extending from said top surface;

mating recessions formed in one of said two side surfaces;

a plurality of connecting members constructed of blow-molded plastic, removably attached to said rail members, and having grooves constructed and arranged to receive said dovetails;

a plurality of top panels constructed of blow-molded plastic, removably attached to said rail members, and having receiving portions constructed and arranged to removably mate with said attachment tabs; and, a plurality of bed legs, each having an upper portion with mating extensions configured to mate with said mating recessions;

whereby said rail members, said connecting members, said bed legs and said top panels all have lengths less than 60 inches in an unassembled state.

17. The bed foundation of claim 16 wherein said mating recessions comprise tack-offs.

18. The bed foundation of claim 16 wherein said mating extensions comprise tongues.

19. The bed foundation of claim 16 further comprising fasteners useable to fixedly attach said bed legs to said rails.

20. The bed foundation of claim 16 further comprising a plurality of mounting brackets, each of said mounting brackets having a horizontal surface constructed and arranged to be sandwiched between the bed leg and a bottom surface of one of said rails.

* * * * *

UNITED STATES PATENT AND TRADEMARK OFFICE

CERTIFICATE OF CORRECTION

PATENT NO. : 6,883,191 B2
DATED : April 26, 2005
INVENTOR(S) : James D. Gaboury et al.

It is certified that error appears in the above-identified patent and that said Letters Patent is hereby corrected as shown below:

Column 10,
Line 35, after “the” and before “section:”, insert -- first --.
Line 46, after “said” and before “rails”, insert -- end --.
Line 53, after “side”, delete “rail” and insert -- rails --.
Line 53, after “first” and before “and”, insert -- section --.

Column 11,
Line 1, after “panel”, delete “attached” and insert -- attachable --.

Signed and Sealed this

Fourth Day of October , 2005

JON W. DUDAS
*Director of the United States Patent and Trademark Office*